US006843383B2

(12) United States Patent
Schneider et al.

(10) Patent No.: US 6,843,383 B2
(45) Date of Patent: Jan. 18, 2005

(54) JIB LOAD LIMITING DEVICE

(75) Inventors: William Dennis Schneider, Malcom, NE (US); Max Fischer, Lincoln, NE (US)

(73) Assignee: National Crane Corporation, Waverly, NE (US)

( * ) Notice: Subject to any disclaimer, the term of this patent is extended or adjusted under 35 U.S.C. 154(b) by 139 days.

(21) Appl. No.: 10/370,714

(22) Filed: Feb. 24, 2003

(65) Prior Publication Data

US 2004/0164042 A1 Aug. 26, 2004

(51) Int. Cl.[7] ..... B66B 23/88
(52) U.S. Cl. ..... 212/278; 73/862.634
(58) Field of Search ..... 212/278; 73/862.634

(56) References Cited

U.S. PATENT DOCUMENTS

| | | | |
|---|---|---|---|
| 2,030,529 | A | 2/1936 | Nash |
| 3,266,638 | A | 8/1966 | Popov |
| 3,638,781 | A | 2/1972 | Comley |
| 3,827,514 | A | 8/1974 | Bradley |
| 3,833,130 | A | 9/1974 | Gerdes et al. |
| 3,924,752 | A | 12/1975 | Hoofnagle |
| 3,990,584 | A | 11/1976 | Strawson et al. |
| 4,003,482 | A | 1/1977 | Cheze |
| 4,057,792 | A | 11/1977 | Pietzsch et al. |
| 4,133,032 | A | 1/1979 | Spurling |
| 4,300,134 | A | 11/1981 | Paciorek |
| 4,368,824 | A | 1/1983 | Thomasson |
| 4,413,691 | A | 11/1983 | Wetzel |
| 4,509,376 | A | 4/1985 | Thomasson |
| 5,645,181 | A | 7/1997 | Ichiba et al. |
| 5,711,440 | A | 1/1998 | Wada |
| 6,044,991 | A | 4/2000 | Freudenthal et al. |
| 6,170,681 | B1 | 1/2001 | Yoshimatsu |

FOREIGN PATENT DOCUMENTS

| | | | |
|---|---|---|---|
| GB | 913507 | * 12/1962 | ..... 212/278 |
| JP | 04112190 | * 4/1992 | |

* cited by examiner

*Primary Examiner*—Thomas J. Brahan
(74) *Attorney, Agent, or Firm*—Birch, Stewart, Kolasch & Birch, LLP

(57) ABSTRACT

A load limiting device for a jib extension includes a pivotal insert adjacent the tip of the jib extension, a cable sheave mounted on the insert, a force measuring device for measuring forces imposed upon the insert by a load on the cable, an angle transducer for measuring the angle of orientation, and means for determining, based upon such force and angle of orientation, the load on the jib extension.

12 Claims, 3 Drawing Sheets

JIB LOAD LIMITING DEVICE

FIELD OF THE INVENTION

The invention relates to a load limiting device for an apparatus such as a lifting crane. Particularly, the invention relates to a load limiting device for a jib extension for lifting apparatus such as a crane.

BACKGROUND OF THE INVENTION

Extensible boom cranes are well known and widely utilized for lifting loads in various situations. Transportable extensible boom cranes are particularly useful in that they may be easily located and relocated to where tasks are to be performed. The present invention relates to a structure for enhancing the safety of operation of extensible boom cranes, transportable or otherwise.

By way of background, FIG. 4 illustrates schematically a transportable extensible boom crane in the form of a truck mounted crane. Such an apparatus comprises generally a truck 1 having an extensible boom crane 2 mounted thereon, as is well known. The crane includes, generally, a base portion 3 mounted to the truck frame and an extensible boom. The boom includes a base section 4 pivotally mounted to base 3 and one or more extensible and retractable sections 5.

A boom tip 6 is mounted at the end-most portion of the furthest extensible section 5. As is well known, boom tip 6 carries one or more rotatable sheaves. A cable associated with the crane passes over the sheaves and supports a hook or other grasping element for raising and lowering loads in a well known manner.

Such cranes, mounted on trucks or other transportable vehicles, often include a system for monitoring the load lifted by the crane and/or the forces imposed by the load to assure that the capacity of the crane is not exceeded at any time. Such systems will be discussed in greater detail hereinafter. Generally, load monitoring systems include sensors for monitoring parameters such as the position of the crane boom, the length of the boom at any point in time, and other parameters indicative of the physical configuration of the crane. Load monitoring systems determine when the capacity of the crane might be exceeded for any configuration of the crane. Thus, such systems enhance the safety of operation.

In some situations, the configuration of the crane might be modified in a manner which could result in readings in a load monitoring system which do not fully represent the configuration of the crane. One such situation is when a jib extension is added to an extensible boom crane. Jib extensions are added, for example, to extend the reach of the crane when necessary or desirable.

FIG. 5 illustrates the manner in which a jib extension might be added to an extensible crane boom. Reference numeral 5 indicates the end-most extensible boom section of a crane generally as discussed with respect to FIG. 4. Normally, one or more sheaves are mounted on boom tip 6.

As illustrated in FIG. 5, a jib extension 20 is secured to boom section 5 in such a manner as to extend the reach of the crane boom. The extension 20 can be mounted so that is it extends generally along the same axial direction as boom section 5, as illustrated. Alternatively, extension 20 can be mounted so that it extends at an angle to the axis of section 5. The cable of the crane will extend past boom tip 6, along the length of the jib extension 20, and over a rotatable extension sheave 38, as will be discussed in greater detail hereinafter.

In a typical arrangement, as illustrated, jib extension 20 is secured to boom section 5 by, for example, a plurality of pins 7 passing through apertures in the jib extension and the boom tip. Such securing arrangements are well known and not part of the present invention.

A known way for monitoring loads on a crane and preventing overload is to install a Load Moment Indicator (LMI) system. The LMI is an electronic system equipped with sensors to measure such parameters as the length of the boom (via a cable reel mounted on the boom or comparable means), the angle of orientation of the boom (via an angle transducer), the hydraulic pressure in the boom lift cylinder, and other relevant parameters. For example, sensors may be provided to indicate the position of stabilizing outriggers in the event that the transportable crane is equipped with such outriggers. The LMI includes a computer for comparing input data from such sensors to capacity information for the crane stored electronically. Such comparison determines if the crane is overloaded when lifting a load in any specific configuration of the boom, outriggers, etc. If an overload condition occurs, a warning signal and/or a control signal can be provided to warn an operator or to curtail crane functions to prevent a dangerous condition.

LMI's are very expensive and are not economically reasonable for smaller cranes. Additionally, data relating to the capacity of a crane relates to the normal variables in the configuration of the crane measurable by the LMI sensors.

An alternative to a complete LMI system is a Hydraulic Capacity Alert system (HCA). The HCA uses a pressure switch in the boom lift cylinder to measure the hydraulic pressure in the lift cylinder required to raise the boom and support or lift the load on the hook. At a preselected pressure, presumed to represent a pressure at which the crane is loaded to an undesired level by the load on the hook, a solenoid valve or other similar device is triggered to terminate the flow of oil to crane functions and/or provide a warning signal to an operator. Terminating or otherwise controlling crane operation in a suitable manner when critical pressure is reached will prevent crane overload from occurring. Such a system is more economical than a full LMI, which makes it more feasible for smaller cranes.

However, an HCA as described requires that, for all configurations of the crane (i.e., all boom lengths, all orientations of the boom), the same hydraulic pressure in the lift cylinder must be regarded as the limiting load factor. This may prevent the crane from achieving optimal operating conditions in some configurations.

The HCA may not protect a jib extension itself from overload. When a jib extension is mounted to the end of an extensible crane boom and a load is lifted using the jib extension, it is conceivable that the load capacity of the jib extension itself could be exceeded while the load capacity of the crane, as a whole, is well within safe limits. Therefore, it is important to provide means for assuring that the load capacity of the jib extension itself is not exceeded.

Accordingly, it is an object of the invention to provide an auxiliary load limiting device for a lifting crane, especially for a jib extension for a boom of a lifting apparatus.

An object of the invention is to provide such a load limiting device which may be readily utilized with any such lifting apparatus. A further object is to provide such a load limiting device which is economical for cranes of any relative size and cost.

DETAILED DESCRIPTION OF THE PREFERRED EMBODIMENTS

Figure 1:
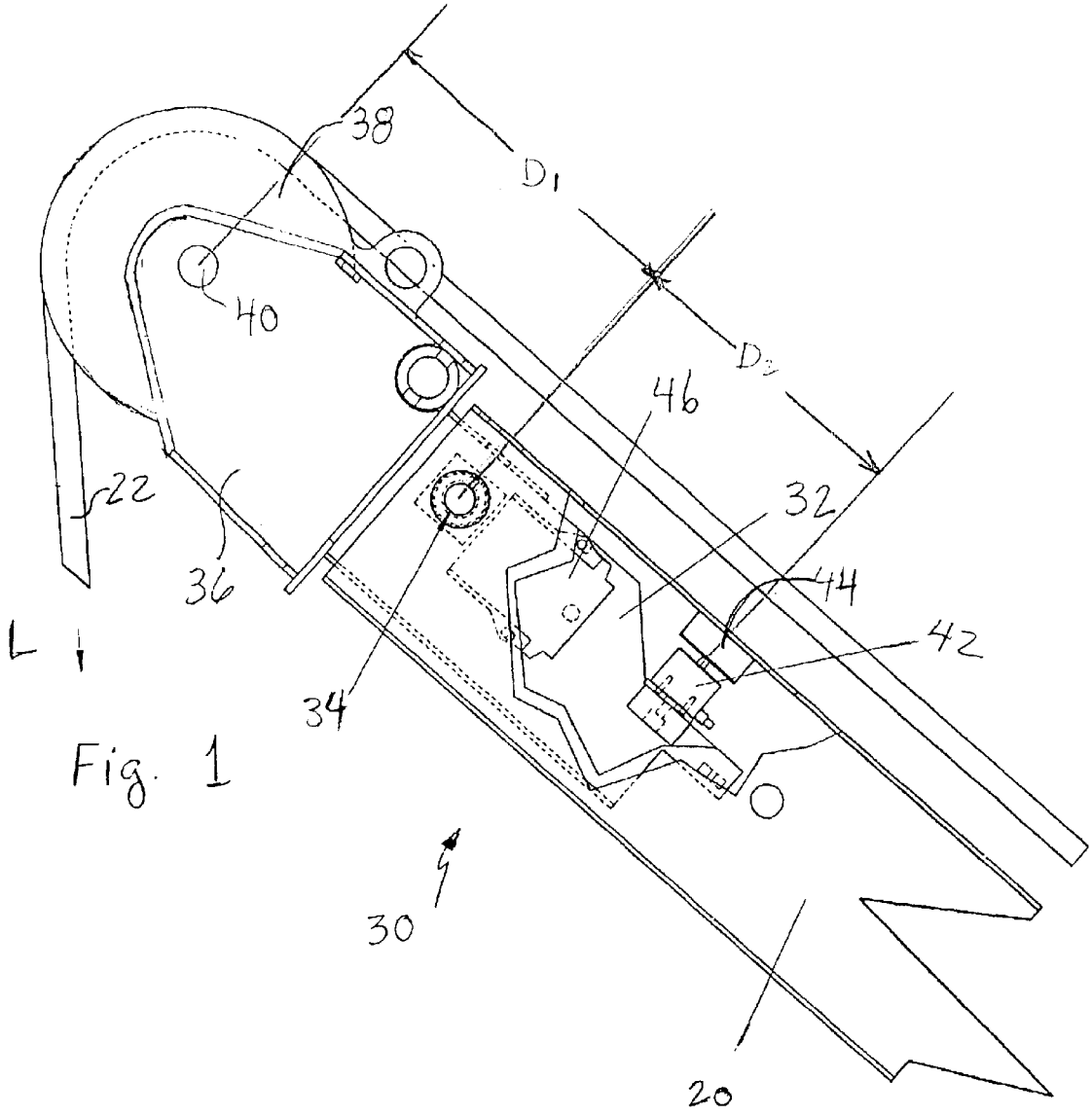
FIG. 1 illustrates a first embodiment of a load limiting device according to the present invention.
Figure 4:
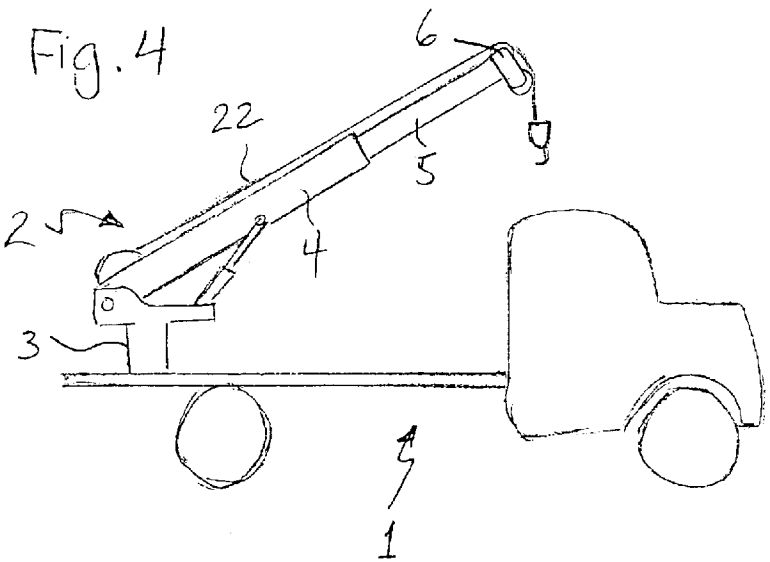
FIG. 4 is a schematic illustration of a truck-mounted crane which illustrates an environment in which the present invention might be utilized.

FIG. 1 illustrates a first embodiment of the invention, generally designated by reference numeral 30. A device in accordance with the invention is mounted on a jib extension 20, as discussed above with respect to FIG. 4.

The illustration of jib extension 20 is partly broken away to show an insert 32 inserted at the tip of jib extension 20. Insert 32 is pivotally mounted to jib extension 20 at a pivotal mount 34 positioned at a first location. Mount 34 may be, for example, a chrome plated pivot pin supported on extension 20 or any comparable device for permitting the insert to pivot when a force is applied. Alternatively, pin 34 or a similar element could be mounted on insert 32 and extend into apertures associated with jib extension 20.

An extended portion 36 of insert 32 rotationally supports a sheave 38 on a rotational axis 40 positioned at a second location on insert 32. In this embodiment, the second location of axis 40 is displaced from the first location of pivot 34 in a first direction generally parallel to the axis of jib extension 20.

The illustration of jib insert 32 is itself shown partly broken away to illustrate a load cell 42 mounted on insert 32. Load cell 42 is mounted on insert 32 at a third location which is spaced from the first location of pivot 34 generally along the axis of extension 20 in a direction opposite from the direction of displacement of axis 40.

Load cell 42 bears against a block or pad 44 which is mounted on jib extension 20.

A load limiting device according to the invention further includes a jib tip computer 46. In a preferred embodiment, the jib tip computer comprises an angle transducer as is well known for providing a signal representing the angular orientation of the insert 32. Because the pivotal movement of insert 32 is very limited, as discussed below, the angular orientation of insert 32 corresponds closely to the angular orientation of the jib extension itself.

A memory associated with computer 46 stores data relating to the capacity of jib extension 20 to support a load. Typically, the data stored may represent limits for such load capacity, which may vary depending upon the angular orientation of the jib extension. Jib tip computer 46 further includes a logic device for receiving and interpreting data. This may comprise, for example, a microprocessor. The angle transducer, memory and logic device may conveniently be integrated in a single device 46, as suggested. It is within the scope of the invention, however, that these elements may be individual or distinct from each other but operatively connected in accordance with the teachings of the invention.

In operation, a lifting cable 22 of the crane on which jib extension 20 is mounted extends along the length of jib extension 20 and passes over sheave 38. The load on the crane hook imposes a force L on cable 22, as illustrated in FIG. 1.

The force on cable 22 imparts a torque or rotational force in insert 32, tending to pivot insert 32 in a counter-clockwise direction about pivotal mount 34. Load cell 42, engaging block 44, provides a reactive force, preventing more than minimal rotation. Load cell 44 measures the reactive force, which represents the force imparted by the load L.

The relationship between the force imparted by load L and the force measured by load cell 42 depends, of course, on the relationship between the distance D1, between axis 40 and pivot 34, to the distance D2, between load cell 42 and pivot 34. Load cell 42 and/or logic associated with jib tip computer 46 are appropriately calibrated so that the signal received from load cell 42 and acted upon by computer 46 appropriately represents the magnitude of the load force imposed by the force L on the jib extension 20.

The angle transducer associated with jib tip computer 46 also provides a signal to the logic means of the computer. In an exemplary embodiment, the logic means receives a signal representing the force of the load on the jib extension, and a signal representing the angular orientation thereof. The data represented by these signals is compared to data stored in the memory portion of the computer representing acceptable load limits for various angular orientations. If it is determined that the load is within limits for the instant orientation, operation of the crane proceeds without interruption or incident.

However, if the load for the instant angular orientation exceeds a safe load for the jib extension as represented by the data stored in memory, one or more signals may be output by the jib tip computer. Such signals may be provided to control devices, which themselves are not part of the present invention, to terminate operation of the lifting apparatus or otherwise curtail operation in a manner so as to relieve the overload and avoid a dangerous condition. Such signals may also be provided to activate a warning device, such as a light or a horn, to alert an operator to the overload condition.

Control signals or warning signals generated by jib tip computer 46 would typically be conveyed to control devices or warning devices located at the base of the crane and/or in an operators cab, normally located at the base of the crane. Such signals would normally be conveyed along the length of the jib extension and along the length of the extensible crane boom. It is common practice to equip cranes with an anti-two block device which assists an operator in keeping the hook block of a crane from being raised to high and contacting the boom tip of the crane. Various ways are known for conveying signals from an anti-two block device at the end of a boom to an operator's control panel and/or control devices at the base of the boom, including signal conductors passing through and along the boom. Such signal conductors may similarly be utilized for transferring signals from jib tip computer 46 to the control devices or control panel of the boom.

A load limiting device according to the invention, as described, provides means for monitoring the load on a jib extension which may be added to an extensible boom, and assuring that the load capacity of the extension will not be exceeded during operation of the lifting apparatus. A device according to the invention, thus, assures the integrity of the jib extension and enhances safety of operation.

Figure 2:
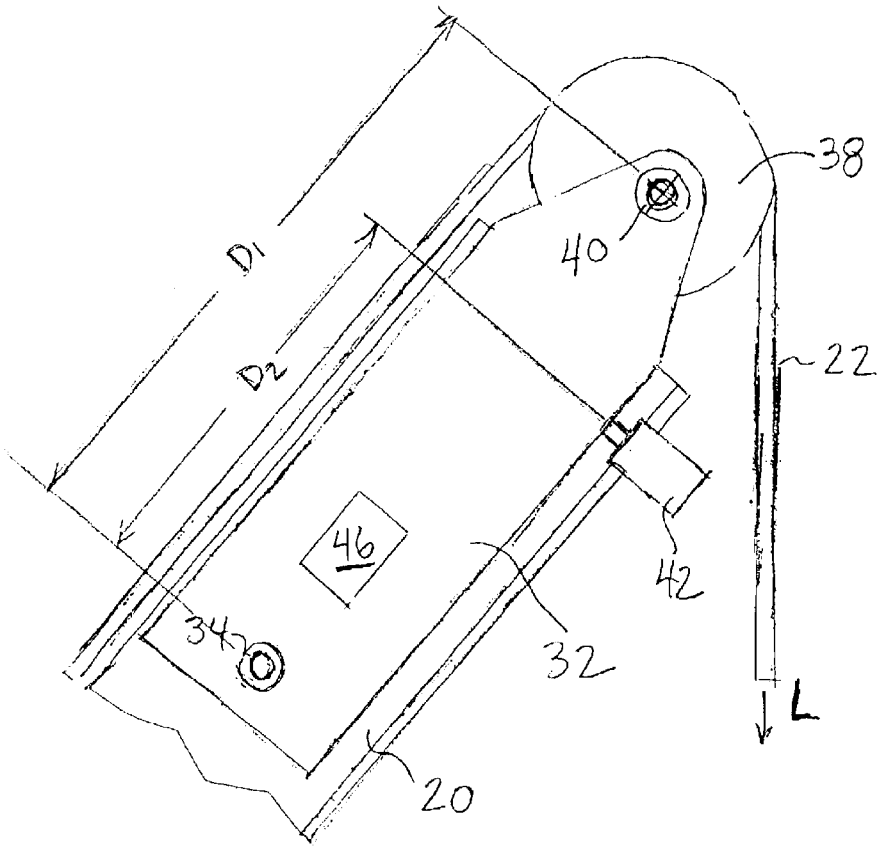
FIG. 2 illustrates a second embodiment of a load limiting device in accordance with the invention.

A second embodiment of the invention is illustrated in FIG. 2. Elements corresponding to those illustrated in FIG. 1 are indicated with similar reference numerals.

FIG. 2 schematically illustrates the jib extension 20 shown cut away to reveal jib tip insert 32 pivotally mounted to the jib extension at pivotal mount 34. Sheave 38 is rotationally supported on insert 32 at axis 40. Axis 40 is spaced from the location of pivotal mount 34 in a direction generally along the axis of extension 20 at a distance D1.

Load cell 42 is supported on jib extension 20. Load cell 42 is spaced from pivotal mount 34 at a distance D2 in a direction generally parallel to the axis of extension 20. Load cell 42 bears directly against a surface of jib tip insert 32. Alternately, load cell 42 could be mounted on inset 32 and bear against a surface of jib extension 20.

In a manner similar to that discussed with respect to FIG. 1, a load on the crane hook imparts a force L on cable 22 which passes about sheave 38. This imparts a rotational force to jib tip insert 32, tending to rotate the insert in a clockwise direction in the view illustrated in FIG. 2. Load cell 42, bearing against jib tip insert 32, prevents all but minimal rotation of the jib insert, and provides a signal representative of force L acting upon the sheave, upon the jib tip insert and, thus, upon jib extension 20.

As discussed above, load cell 42 and/or the logic associated with jib tip computer 46 are appropriately calibrated so that the signal provided by load cell 42 and acted upon by computer 46 represents the load imposed upon the jib extension. As in the embodiment of FIG. 1, jib tip computer 46 also includes an angle transducer for providing a signal representing the angular orientation of the jib tip insert 32 (and, thus, the angular orientation of jib extension 20), as well logic means and capacity data for making a comparison between the instantaneous load and orientation of the jib extension 20 and permissible loads for such orientation.

Figure 3:
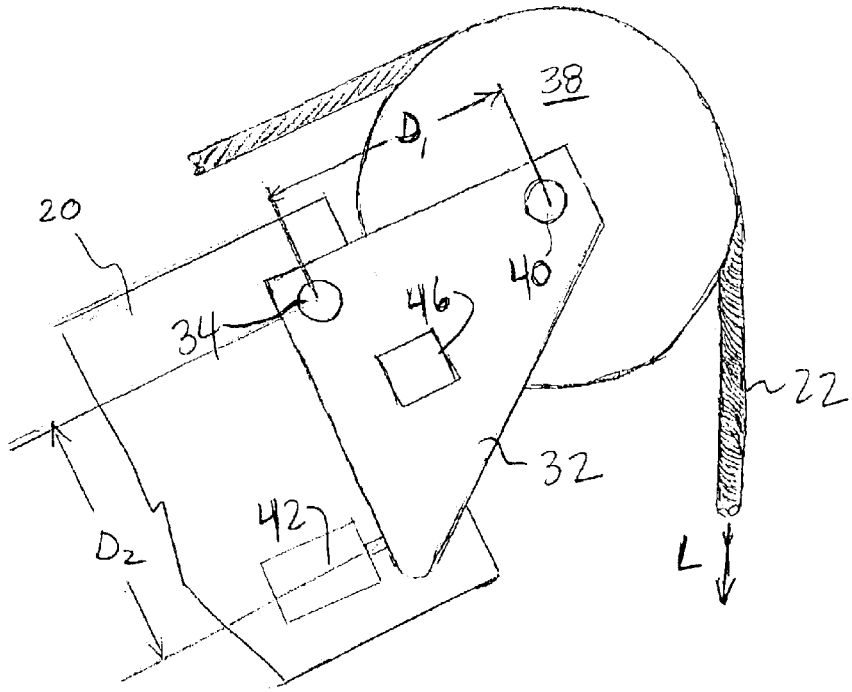
FIG. 3 represents a third embodiment of the present invention.
Figure 5:
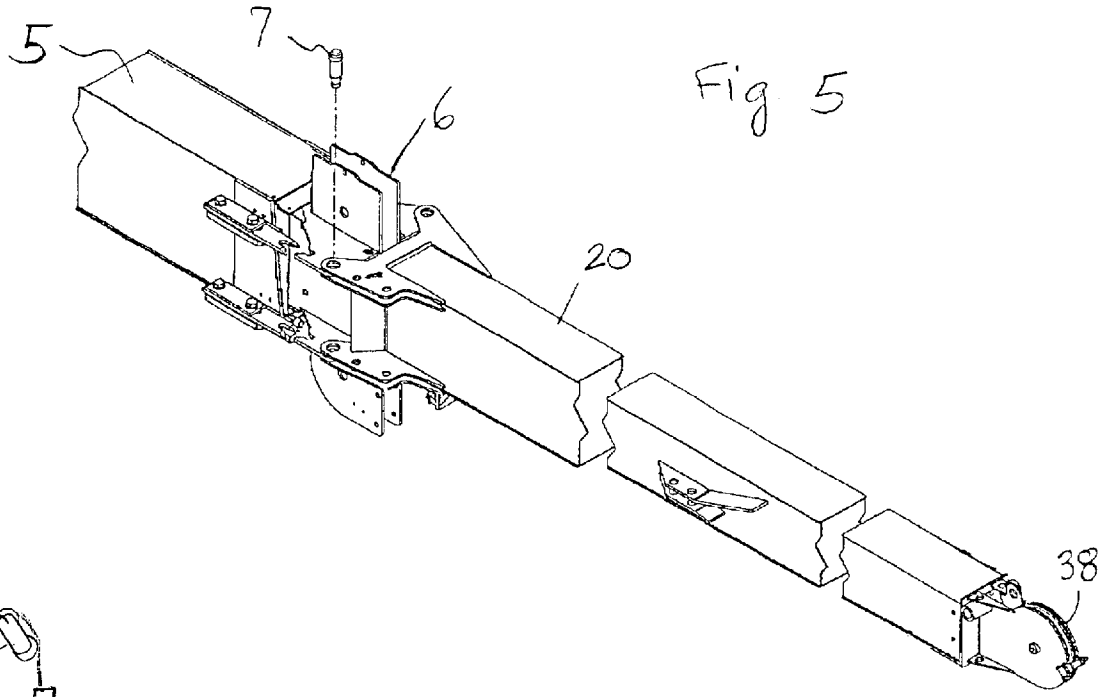
FIG. 5 illustrates the manner in which a jib extension may be added to an extensible boom crane, providing further background for understanding the environment in which the present invention may be utilized.

FIG. 3 illustrates an additional embodiment of the present invention. Again, elements corresponding to those illustrated in FIGS. 1 and 2 are indicated with like reference numerals.

In the embodiment of FIG. 3, jib tip insert 32 is pivotally mounted at the tip of jib extension 20 on pivotal mount 34. Sheave 38 is rotationally mounted at axis 40 which is spaced from pivotal mount 34 at a distance D1 generally in a direction parallel to the axis of jib extension 20. Load cell 42 is mounted on jib extension 20 and bears directly against a portion of jib tip insert 32. Alternatively, load cell 42 could be mounted on insert 32 and bear against a flange or other surface associated with jib extension 20. Load cell 42 is spaced from pivotal mount 34a distance D2 in a direction generally perpendicular to the axis of jib extension 20.

In much the same manner as described above, load force L on cable 22 tends to cause jib insert 32 to pivot about pivotal mount 34 in a clockwise direction as illustrated in FIG. 3. Load cell 42 bearing against insert 32 resists all but minimal rotation of the insert, providing an appropriately calibrated signal to jib tip computer 46. In the manner discussed above, jib tip computer 46 also receives a signal from an angle transducer associated therewith and determines whether the load on jib extension 20 is within limits for the instant angular orientation or if that load exceeds the capacity of the jib extension.

The present invention thus provides an economical and effective means for monitoring loads imposed upon a jib extension which may be added to a crane. The invention enhances the safety of operation of the crane.

The present invention is not limited to the specific details shown and described with respect to the preferred embodiments, but is limited only by the scope of the appended claims.

We claim:

1. A load limiting device for an extension attached to a lifting boom of a lifting apparatus that lift loads by means of a lifting cable; said load limiting device comprising:

an insert adjacent the remote end of said extension and pivotally mounted to said extension at a first location;

a cable sheave mounted on said insert at a second location for receiving and supporting the lifting cable of said apparatus during lifting operations;

a force measuring device associated with said extension, said force measuring device engaging said insert at a third location for measuring the force imposed on said sheave by the lifting cable;

an angle transducer associated with said insert for measuring the angle of orientation thereof;

a calculating device which receives a signal from said force measuring device and a signal from said angle transducer, said calculating device comprising means for determining the load on said extension based upon said force and said angle of orientation; and control means for determining if an overload condition is occurring in said extension and for controlling operation of the lifting apparatus.

2. A load limiting device as in claim 1, wherein said second location is offset from said first location in a first direction generally parallel to the longitudial axis of said extension, and said third location is offset from said first location in a second direction generally opposite said first direction.

3. A load limiting device as in claim 2, wherein force imposed on said sheave by the cable causes said insert to pivot with respect to said extension, and said force measuring device exerts a reactive force and measures the force imposed by the cable.

4. A load limiting device as in claim 1, wherein said second location and said third location are both offset from said first location in the same direction generally parallel to the longitudinal axis of said extension.

5. A load limiting device as in claim 3, wherein force imposed on said sheave by the cable causes said insert to pivot with respect to said extension, and said force measuring device exerts a reactive force and measures the force imposed by the cable.

6. A load limiting device as in claim 1, wherein at least one of said second location and third location is offset from said first location in a direction generally perpendicular to the longitudinal axis of said extension.

7. A load limiting device as in claim 6, wherein force imposed on said sheave by the cable causes said insert to pivot with respect to said extension, and said force measuring device exerts a reactive force and measures the force imposed by the cable.

8. A load limiting device as in claim 1, wherein force imposed on said sheave by the cable causes said insert to pivot with respect to said extension, and said force measuring device exerts a reactive force and measures the force imposed by the cable.

9. A load limiting device as in claim 1, wherein said calculating device is a data processor.

10. A load limiting device as in claim 1, wherein said control means comprises a comparison means for comparing actual load conditions on said extension to load limit conditions for said extension.

11. A load limiting device as in claim 1, wherein said control means provides a signal to the lifting apparatus for curtailing operations of the apparatus when a load limit condition is attained in said extension.

12. A load limiting device as in claim 1, wherein said control means provides a signal to warn an operator of the lifting apparatus when a load limit condition is attained in said extension.

* * * * *